United States Patent [19]

Schwab

[11] Patent Number: 4,571,976

[45] Date of Patent: Feb. 25, 1986

[54] BLIND RIVETING APPARATUS FOR RIVETS OF DIFFERENT SIZES

[75] Inventor: Manfred F. Schwab, Wiesbaden, Fed. Rep. of Germany

[73] Assignee: Alfred Honsel Nieten- und Metallwarenfabrik GmbH & Co., Froendenberg, Fed. Rep. of Germany

[21] Appl. No.: 585,493

[22] Filed: Mar. 6, 1984

[30] Foreign Application Priority Data

Jan. 13, 1984 [DE] Fed. Rep. of Germany ..... 3400942

[51] Int. Cl.[4] ..... B21D 9/05

[52] U.S. Cl. ..... 72/391; 91/59

[58] Field of Search ..... 72/391, 114; 91/59, 91/468; 137/505.41

[56] References Cited

U.S. PATENT DOCUMENTS

| | | | |
|---|---|---|---|
| 2,223,838 | 12/1940 | Tweedale | 91/468 |
| 3,373,824 | 3/1968 | Whithouse | 91/59 |
| 3,885,589 | 5/1975 | Iung | 137/505.41 |
| 4,320,806 | 3/1982 | Koltermann et al. | 91/59 |
| 4,321,814 | 3/1982 | Martin | 72/391 |

*Primary Examiner*—Francis S. Husar
*Assistant Examiner*—Linda McLaughlin
*Attorney, Agent, or Firm*—Barnes, Kisselle, Raisch, Choate, Whittemore & Hulbert

[57] ABSTRACT

In a blind riveting apparatus for rivets of different sizes, with a compressed air feed line and an actuating means controllable by the compressed air, and a rotary motor, provided at the inlet (6) of the compressed air feed means (9) into the blind riveting apparatus (1) is a means (10) for setting the level of the pressure of the compressed air which flows into the apparatus (1).

14 Claims, 4 Drawing Figures

BLIND RIVETING APPARATUS FOR RIVETS OF DIFFERENT SIZES

The invention relates to a blind riveting apparatus for rivets of different sizes, having a compressed air feed means and an actuating means which is controllable by the compressed air, and a rotary motor.

Conventional blind riveting apparatuses give rise to difficulties in dealing with rivets of different sizes. In addition, there is the consideration that the rivets comprise different materials. In practice, there is a need to be able to have one apparatus for riveting 4 mm aluminium rivets to 10 mm steel rivets. If an apparatus is designed for the 10 mm steel rivets, then the forces produced are such that the thread of a 4 mm aluminium rivet can be torn out. If however, the apparatus is designed for 4 mm aluminium rivets, then using the apparatus for riveting 10 mm steel rivets gives rise to difficulties, or is totally impossible.

The invention is therefore based on the object of providing a blind riveting apparatus which can be used for riveting rivets of different sizes and properties of material.

The invention provides that disposed at the inlet of the compressed air feed means into the blind riveting apparatus is a means for setting the level of the pressure of the compressed air which flows into the apparatus.

Desirably, the setting means reduces the pressure of the air arriving in the compressed air feed means, to a lower pressure.

Advantageously, the setting means can be set to different pressure levels.

It is of particular advantage for the setting means to pass air to the drive motor of the apparatus, at the pressure of the air from the compressed air feed, and to reduce the pressure when the motor, for actuating the riveting operation is cut off. Advantageously, the pressure of the air supplied in the compressed air feed means is reduced from 6 bars to 3 to 4 bars.

An advantageous embodiment of the invention provides that a stepped piston is carried in a cylinder having corresponding portions of large and small diameter, wherein the small-diameter portion is disposed at the end towards the inlet of the compressed air feed means and the larger-diameter portion is disposed at the end towards the actuating means, and that a by-pass duct leads from the cylinder portion at the inlet end to the oppositely disposed cylinder portion, and a connecting duct branches from the by-pass duct to the rotary motor of the apparatus.

In a further development, the invention proposes that the cylinder has a transverse bore in which a setting pin is movably disposed, the pin having a first cross-sectional portion whose diameter corresponds to that of the transverse bore, and a second portion of reduced cross-section.

In a modified embodiment, the invention proposes that an axially movable setting pin is arranged in oppositely disposed relationship to the stepped piston on the smaller-diameter side, and that a spring is disposed between the stepped piston and the setting pin.

Advantageously, a coil spring extends between the stepped piston and the setting pin and engages around respective extension portions provided thereon. In its forwardly displaced position, the setting pin can bear by way of its end surface against the stepped piston and can move it away from its seat.

In accordance with a further embodiment, there is provided an air distribution chamber from which go a motor compressed air duct and a cylinder compressed air duct, the latter communicating with a chamber between the stepped piston and the setting pin. The pressure distributor chamber has a valve seat in which the end of an actuating rod sits and, in the rest position, opens the motor compressed air duct, but upon actuation closes the motor compressed air duct and opens the cylinder compressed air duct.

The invention will now be described in greater detail by means of an embodiment with reference to the accompanying drawing in which.

Figure 1:
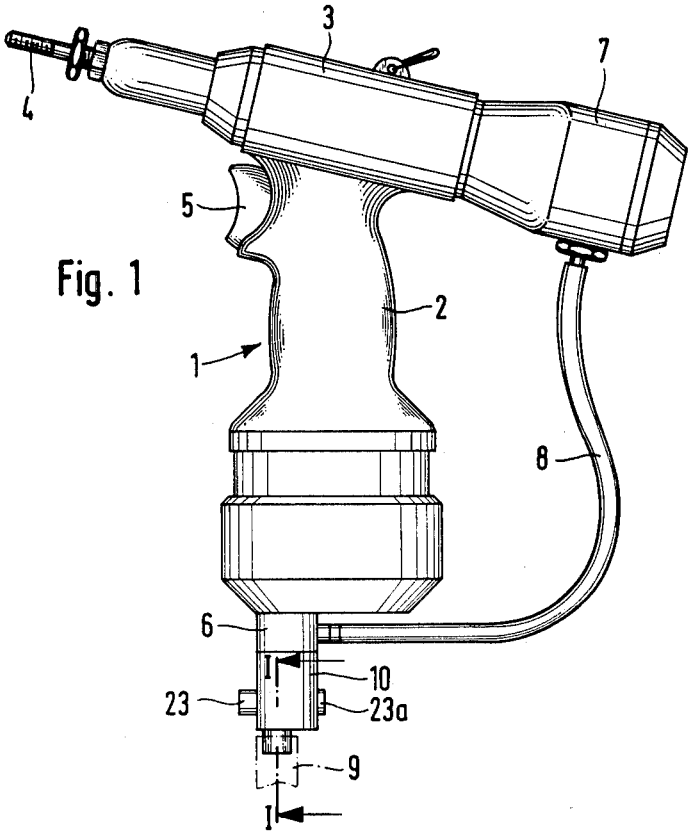
FIG. 1 shows an external view of a blind riveting tool.

Referring to FIG. 1, shown therein is a blind rivet setting tool 1 comprising a gripping or handle portion 2. Mounted centrally in the head portion 3 of the apparatus is a screwthreaded pin 4 which is caused to rotate for screwing on a threaded rivet nut (not shown). An upsetting operation whereby an axial movement is imparted to the threaded pin 4 is triggered by means of an actuating member 5. After that operation, the threaded pin 4 is caused to rotate in the opposite direction, for unscrewing the screwthreaded rivet nut.

The compressed air required for operation of the apparatus passes into the apparatus 1 by way of an inlet connection. A rotary motor 7 is supplied with compressed air by way of a compressed air hose 8 while the actuating member 5 triggers the upsetting operation by way of a piston arrangement disposed in the handle portion 2.

Figure 2:
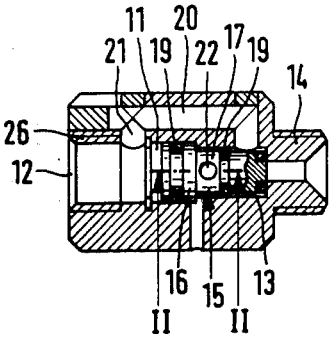
FIG. 2 shows a view of the pressure setting means in section taken along line I—I in FIG. 1.

The upsetting operation requires a different pressure from the pressure of the air which is supplied to the apparatus through the compressed air feed line 9. When dealing for example with 10 mm steel rivets, a pressure of about 6 bars is required for the apparatus, while when dealing for example with 4 mm aluminium rivets, the rivets can be satisfactorily set with an air pressure of 3 to 4 bars only, as, if a higher pressure were employed, the screwthread of the rivets may be pulled out. For that reason, provided on the blind riveting apparatus 1 is a pressure setting means 10 at which the pressure of the air supplied to the apparatus in the compressed air feed line 9 can be set or adjusted. As shown in FIG. 2, the pressure setting means 10 comprises a cylindrical chamber which has a portion 11 with a larger section which is towards the connection 12 to the actuating means (not shown in greater detail) in the handle portion 2. A cylinder chamber portion 13 which is of reduced cross-section is disposed towards the feed connection 14 to which the compressed air feed line 9 (see FIG. 1) is connected.

To correspond to the different diameters of the cylinder chamber portions 11 and 13, carried therein is a stepped piston 15 having a piston portion 16 of larger diameter and a piston portion 17 whose diameter is smaller than that of the piston portion 16. The stepped piston 15 is sealed by O-seals 19. A by-pass duct 20 leads from the small-diameter cylinder chamber 13 to the other side of the stepped piston 15, into the cylinder chamber 11 which is of larger cross-section, while a communicating duct 21 branches from the by-pass passage 20 and is connected by way of a hose 8 to the rotary motor 7 of the apparatus 1.

Figure 3:
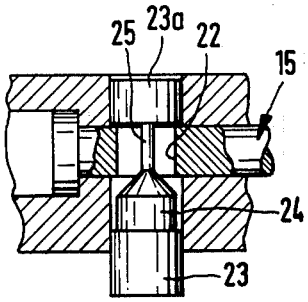
FIG. 3 shows a view of the pressure setting means in section taken along line II—II in FIG. 2.

The stepped piston 15 has a transverse bore 22 in which a setting pin 23 is carried, as shown in FIG. 3. The setting pin 23 has a first cross-sectional portion 24 which corresponds to the diameter of the transverse bore 22 in the stepped piston 15. A second cross-sectional portion 25 is of substantially smaller diameter than the transverse bore 22 so that the stepped piston 15 is capable of moving axially with respect to the setting pin 23.

In this case, the blind riveting apparatus 1 operates at a reduced pressure. For example, the pressure of 6 bars at which the air is supplied to the apparatus in the compressed air feed line 9 is reduced to a pressure of 3 to 4 bars during the riveting operation. In that case, the air arriving from the compressed air feed line 9 passes through the bore of the connection 14 and displaces the stepped piston 15 towards the left in FIG. 2 so that it can pass to the rotary motor 7 by way of the by-pass duct 20, the duct 21, and the hose 8. The rotary motor 7 can now operate in that way under the full air pressure of 6 bars, and the rivet can be screwed on. When that operation is concluded, the motor is stopped and the compressed air can no longer flow away. In that manner, a pressure is built up in the cylinder portion 11 which is of larger diameter, and displaces the stepped piston 15 towards the right in FIG. 2 so that the compressed air feed is shut off to prevent further feed of compressed air. By virtue of the appropriate dimensioning of the stepped piston, that results in a pressure of 3 to 4 bars in the cylinder chamber 11, the air under that pressure flowing by way of the connection 12 into the actuating means for the riveting operation, disposed in the handle portion 2. When the riveting operation is concluded, the pressure is released through a compressed air port and the stepped piston moves towards the left in FIG. 2 so that once again the full pressure of the air supplied to the apparatus in the compressed air feed line 9 is available.

If a reduction in pressure of the above-indicated kind is not required, the setting pin 23 is pushed inwardly. In that way, the portion 24 of the setting pin 23 moves into the bore 22 and thus secures the stepped piston 15 in a position in which it cannot move and cannot shut off the feed of compressed air at the inlet connection 14 so that the apparatus only operates with the full pressure of the air supplied in the compressed air feed line. A reduction in pressure is again effected during the riveting operation, by the setting pin being returned to the illustrated position by a pressure applied to the opposite end 23*a* thereof.

As shown in FIG. 2, the pressure setting means is provided with a screwthread and can be screwed into a corresponding screwthread on the inlet connection 6 which is not shown. In that way, it is also possible to mount different pressure setting means on the apparatus in order in that way to vary the pressure settings produced.

Figure 4:
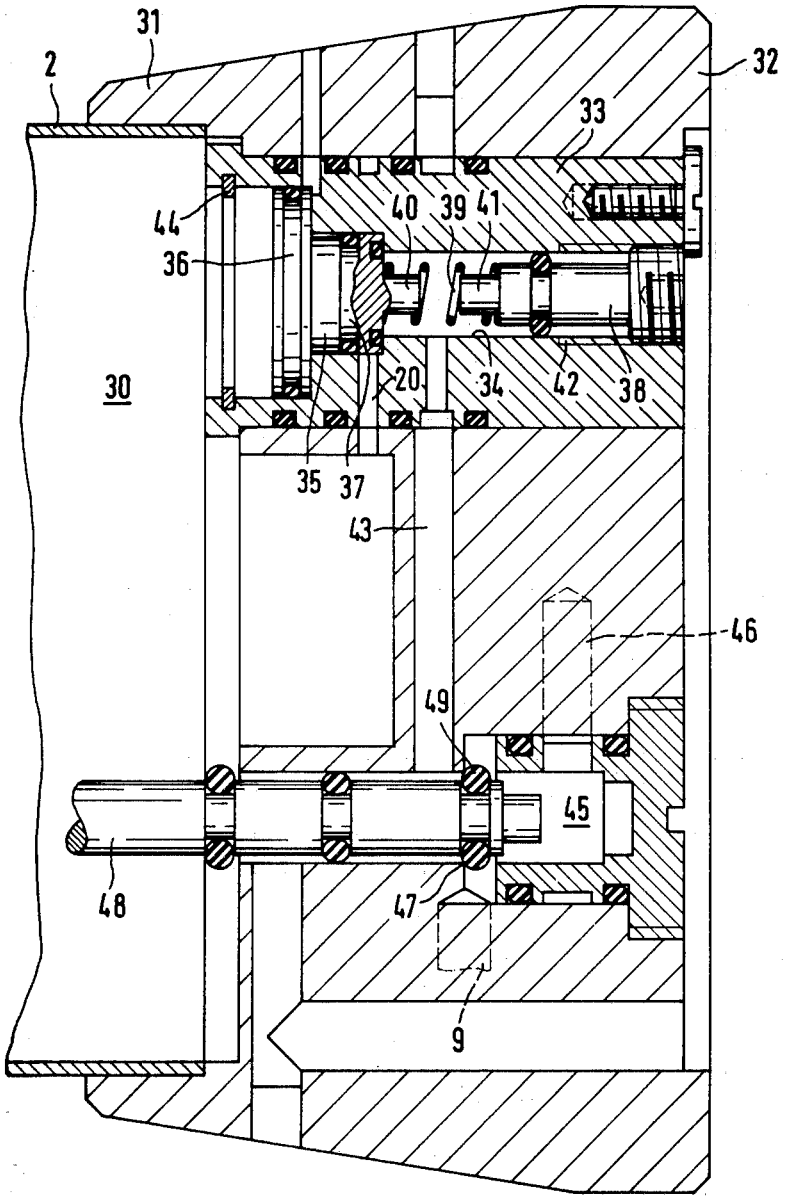
FIG. 4 shows a cross-sectional view of a modified pressure setting means.

FIG. 4 shows a modified pressure setting means which permits continuous pressure adjustment.

The modified pressure setting means illustrated embraces the whole end of the handle portion 2 and closes off the pressure chamber 30 therein, by being mounted thereto at the lower end by means of an annular flange portion 31 which is formed on the casing 32 of the pressure setting means.

Carried in the casing 32 of the pressure setting means is a bush or sleeve 33 which has a cylinder bore 34. The end of the cylinder bore 34 which is towards the pressure chamber 30 has a seat for a stepped piston 35 which has a piston portion 36 of larger diameter, which is towards the pressure chamber 30, while the piston portion 37 of reduced diameter closes off the cylinder chamber 34. Provided at the end of the cylinder chamber which is remote from the stepped piston 35 is a setting pin 38 which is axially movable with respect to the stepped piston 35 in the cylinder chamber 34. Provided between the stepped piston 35 and the setting pin 38 is a coil spring 39 which at one end engages around an extension portion 40 on the stepped piston and at the other end engages around an extension portion 41 on the setting pin 38. The setting pin 38 is screwed into the cylinder sleeve 33 by means of a screwthread 42 and in that way can be moved in the cylinder chamber 34. Depending on the extent to which the coil spring 39 is compressed, the force which acts on the smaller-diameter side of the stepped piston is increased, and moves the stepped piston 35 towards the pressure chamber 30.

When compressed air flows into the cylinder chamber 34 through the compressed air cylinder duct 43, the piston is firstly moved towards the left in FIG. 4, and the air flows through the by-pass duct 20 into the compressed air chamber 30 and acts on the surface of the piston portion 36 of larger diameter, so that the piston moves back towards the right in FIG. 4 until the desired condition of equilibrium occurs. That can be continuously adjusted by movement of the setting pin 38 in the cylinder chamber 34, and the resulting change in the force applied by the spring 39.

If it is desired for the compressed air to take full effect in the pressure chamber 30 for example at a pressure of 6 atmospheres, then the setting pin 38 is displaced towards the left to such a degree that the end face of the extension portion 41 of the setting pin comes to bear against the end face of the extension portion 40 on the stepped piston, and the piston is moved towards the pressure chamber 30 until the larger-diameter portion 36 of the piston comes to bear against the stop ring 44. In that way, the by-pass duct 20 is opened and the compressed air from the cylinder compressed air duct at for example 6 atmospheres can flow directly into the pressure chamber.

In the modified embodiment illustrated in FIG. 4, the compressed air line 9 opens into a cylindrical compressed air distributor chamber 45 from which extend a cylinder compressed air duct 43 and a motor compressed air duct 46. A valve seat 47 in the compressed air distributor chamber 45 is closed by means of a O-ring seal 49 in the rest position of the actuating rod 48 so that the air can flow directly from the compressed air feed line 9 into the motor compressed air duct 46 by way of the distributor chamber 45. When the actuating member 5 (see FIG. 1) is actuated, then the actuating rod 48 in FIG. 4 is moved towards the right and the part of the compressed air distributor chamber from which the motor compressed air duct 46 extends is closed off by the O-ring seal 49, but the path to the cylinder compressed air duct 43 is opened so that the compressed air from the compressed air feed line 9 can flow by way of the compressed air distributor chamber 45 into the cylinder compressed air duct and from there by way of the by-pass 20 into the pressure chamber 30 for performing the upsetting operation.

In that way, the blind rivet setting apparatus can be used for different rivets of different sizes and different material, in that a means for setting the pressure level provides that the apparatus can be readily adapted to the various circumstances involved.

I claim:

1. A blind riveting apparatus for rivets of different sizes, having a compressed air feed means and an actuating means which is controllable by the compressed air, and a rotary drive motor, characterised in that the actuating means comprises a screw threaded pin (4) which is rotated by the drive motor (7) for screwing on a threaded rivet nut and an actuating member (5) applies axial movement to said pin (4) to upset a rivet and the motor is rotated in the opposite direction for unscrewing the rivet nut and air feed means (9) directs air to an inlet (6) and that disposed at the inlet (6) into the blind riveting apparatus (1) is a setting means (10) for setting the level of the pressure of the compressed air which flows into the apparatus (1) and in that the setting means (10) passes air to the drive motor (7) of the apparatus (1), at the pressure of the air from the compressed air feed means (9), and reduces the pressure to the motor (7) when the riveting operation is concluded.

2. Apparatus according to claim 1 characterised in that the setting means (10) reduces the pressure of the compressed air arriving from the compressed air feed means (9), to a lower pressure.

3. Apparatus according to claim 1 characterised in that the setting means (10) can be set to different pressures.

4. Apparatus according to claim 3 characterised in that the pressure of the air supplied in the compressed air feed means (9) is reduced from six bars to three to four bars.

5. Apparatus according to claim 4 characterised in that the pressure setting means (10) can be screwed into the blind riveting apparatus (1) at the location (6) of the compressed air feed.

6. A blind riveting apparatus according to one of claims 1 to 5 characterised in that the setting means (10) comprises a stepped piston (15, 16, 17) carried in a cylinder having corresponding portions (11, 13) of large and small diameter, wherein the small-diameter portion (13) is disposed at the end towards an inlet (14) of the compressed air feed means (9) and the larger-diameter portion (11) is disposed at the end towards the actuating means (5), and that a by-pass duct (20) leads from the cylinder portion (13) at the inlet end (14) to the oppositely disposed cylinder portion (11).

7. Apparatus according to claim 6 characterised in that a connecting duct (21) branches from the cylinder portion (11) to the rotary motor (7) of the apparatus (1).

8. Apparatus according to claim 7 characterised in that the cylinder (15) has a transverse bore (22) in which a setting pin (23) is movably disposed, the pin (23) having a first cross-sectional portion (24) which corresponds to the diameter of the transverse bore (22) and a second portion (25) of reduced cross-section.

9. Apparatus according to claim 6 characterised in that an axially movable setting pin (38) is arranged in oppositely disposed relationship to the stepped piston (35) on the smaller-diameter side (37) and that a spring (39) is disposed between the stepped piston (35) and the setting pin (38).

10. Apparatus according to claim 9 characterised in that a coil spring (39) extends between the stepped piston (35) and the setting pin (38) and engages around an extension portion (40) on the stepped piston, at one end, and around an extension portion (41) on the setting pin, at the other end.

11. Apparatus according to claim 10 characterised in that, in its forwardly displaced position, the setting pin (38) bears by way of its end surface against the stepped piston (35) and moves same away from its seat.

12. Apparatus according to claim 11 characterised in that the setting pin (38) is carried in the housing (33, 32) displaceably by screwthread means (42).

13. Apparatus according to claim 12 characterised in that there is provided an air distributor chamber (45) from which go a motor compressed air duct (46) and a cylinder compressed air duct (43), the latter communicating with a cylinder chamber (42) between the control piston (35) and the setting pin (38).

14. Apparatus according to claim 13 characterised in that the pressure distributor chamber (45) has a valve seat (47) in which the end of an actuating rod (48) sits and, in the rest position, communicates the compressed air feed means (9) to the motor compressed air duct while upon actuation it closes the motor compressed air duct and opens the way to the cylinder compressed air duct (43).

* * * * *